United States Patent [19]

Bentley

[11] 4,142,734

[45] Mar. 6, 1979

[54] CROSS COUNTRY PLATE SKI BINDING

[76] Inventor: Richard P. Bentley, Box 786, Tupper Lake, N.Y. 12986

[21] Appl. No.: 801,330

[22] Filed: May 27, 1977

[51] Int. Cl.[2] ..... A63C 9/02

[52] U.S. Cl. ..... 280/615; 24/197

[58] Field of Search ..... 280/615, 614, 618, 620, 280/635, 619, 11.1 BT; 24/197, 63 SK

[56] References Cited

U.S. PATENT DOCUMENTS

| | | | |
|---|---|---|---|
| 485,481 | 11/1892 | Tileston | 24/197 |
| 1,260,124 | 3/1918 | Ashley | 280/618 |
| 2,853,757 | 9/1958 | Rave | 24/197 |
| 3,851,892 | 12/1974 | Swenson | 280/615 |
| 3,957,183 | 5/1976 | Gadberry | 24/197 |

FOREIGN PATENT DOCUMENTS

| | | | |
|---|---|---|---|
| 389409 | 2/1924 | Fed. Rep. of Germany | 280/618 |
| 591086 | 1/1934 | Fed. Rep. of Germany | 280/635 |
| 831210 | 2/1952 | Fed. Rep. of Germany | 280/614 |
| 834345 | 11/1938 | France | 280/11.1 BT |
| 869549 | 2/1942 | France | 280/618 |
| 1110048 | 2/1956 | France | 280/619 |

*Primary Examiner*—David M. Mitchell

[57] ABSTRACT

A binding comprised of a flexible sole plate attached to a ski or other equipment at the toe, adjustable brackets attached to the sole plate at the sides of the toe and heel to restrict lateral movement of the toe and heel relative to the ski, and toe and heel straps to secure the foot to the binding. The toe strap passes over the toe and is attached to the front portion of the sole plate. The heel strap passes around the ankle, crosses behind the heel, and is attached to the rear portion of the sole plate.

3 Claims, 6 Drawing Figures

CROSS COUNTRY PLATE SKI BINDING

SUMMARY OF THE INVENTION

The present invention relates to a new and useful design for a binding found to be particularly advantageous for cross country skiing. Ski bindings generally fall into one of two categories. Down hill skiing requires a firm attachment of the skier's foot to the ski, and bindings for such use provide for a rigid attachment of the ski boot to the ski at both the toe and heel. Cross country skiers must have a less rigid binding because the skier's normal stride requires raising the heel of the foot off the ski. However, a cross country binding, represented by the present invention, must provide good control by resisting lateral movement of the foot, relative to the ski.

The present invention provides a flexible sole plate, attached to the ski beneath the toe, leaving the rear portion of the sole plate, passing back under the heel, free to flex up and down with the heel throughout a normal stride. Adjustable brackets at both sides of the toe and heel effectively prevent lateral movement of either the toe or heel relative to the sole plate, and to the ski, thus providing excellent lateral control.

A popular cross country ski binding called a toe clip binding has been used for a number of years. The toe clip binding is simple and inexpensive, but can be used only with special cross country ski shoes. The special footwear is far more expensive than the toe clip binding and the requirement of different sizes to fit everyone in a family, a school or club skiing program, growing children from year to year, and customers of a ski rental business involves a very considerable expense that must be considered accessory to the toe clip cross country binding. Furthermore, the toe clip binding, ski shoe combination is designed primarily for racing where the skiers use prepared trails, and physical activity provides ample body heat. The special toe clip binding footwear is cut low to facilitate free ankle movement and the ski shoes are generally no heavier than an ordinary pair of street shoes. Consequently, the vast majority of cross country skiers who do not race must either use the toe clip binding, and endure cold feet, or use a cross country binding that allows the use of conventional insulated winter footwear. Such bindings are in demand by all those who cross country ski for pleasure as well as by those whose job requires cross country skiing, for example, forest rangers, military personnel, and search and rescue organizations.

The present invention has adjustable toe and heel brackets, and a toe and heel strap configuration designed specifically to allow the use of a wide variety of conventional winter footwear over a wide range of sizes. At the same time, this invention provides generally better control, and about the same freedom of movement afforded by the toe clip binding.

There are cross country ski bindings that do not require special footwear, such as cable bindings and moulded plastic bindings, among others. All of these bindings are either far more expensive, less durable, less adjustable to different sizes and types of footwear, or provide significantly less control, greater discomfort, and less freedom of movement than the present invention.

A main object of this invention is a binding that provides excellent lateral control in combination with free heel lift.

Another important object is to provide a binding that will accomodate footwear over a wide range of sizes and shapes.

A further important object of this invention is to provide a binding that is relatively inexpensive to manufacture.

Another object is a binding not easily damaged by hard use and exposure to the elements.

Further objects include a binding of simple construction that is easily adjusted to footwear of different shapes and sizes, and which is easy to put on and take off.

Other features and advantages of the present invention will be apparent from the following description, taken in connection with the accompanying drawings.

DESCRIPTION OF THE PREFERRED EMBODIMENTS

Figure 1:
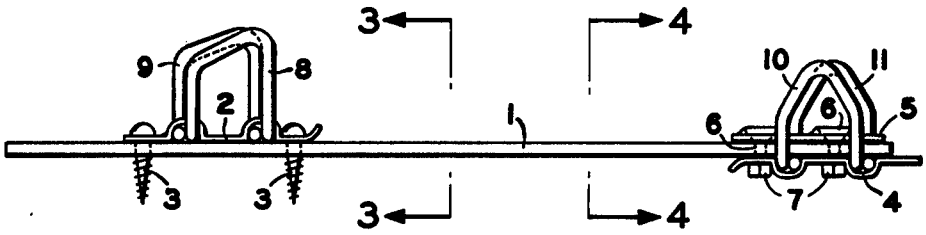
FIG. 1 is a side elevation view of the binding with the toe and heel straps removed, and in which dotted lines indicate hidden parts.

The binding of the present invention consists of a uni-flexible sole plate 1 attached securely to the ski or other equipment 15 at the forward end of the sole plate 1 with a toe clamp plate 2, and mounting screws 3. The heel portion of the sole plate 1 is sandwiched between a heel clamp plate 4 below, and a heel top plate 5 above, which are fastened securely together with heel plate screws 6 and nuts 7. Toe brackets 8 and 9 are inserted, one into each side, in the channels of the toe clamp plate 2, and are held securely in place when the toe clamp plate 2 is tightened down against the sole plate 1 and the ski 15 with mounting screws 3. Heel brackets 10 and 11 are inserted, one into each side, in the channels of the heel clamp plate 4, and are held securely in place when the heel clamp plate 4 is tightened up against the sole plate 1, and the heel top plate 5 with heel plate screws 6 and nuts 7. This assembly is clearly shown in FIGS. 1, 2, and 5.

An alternate arrangement of the parts could have the sole plate attached to the ski or other equipment at a point forward of the toe clamp plate, and the toe clamp plate and toe brackets would be attached to the sole plate with nuts, bolts, and top plate in the same manner as the heel clamp plate.

Figure 3:
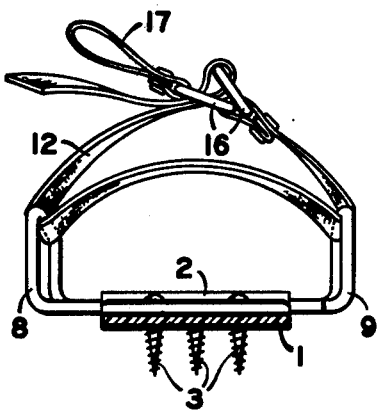
FIG. 3 is an elevation view of the toe portion of the binding viewed from the sectional plane taken along line 3—3 of FIG. 1 with the toe strap attached.
Figure 4:
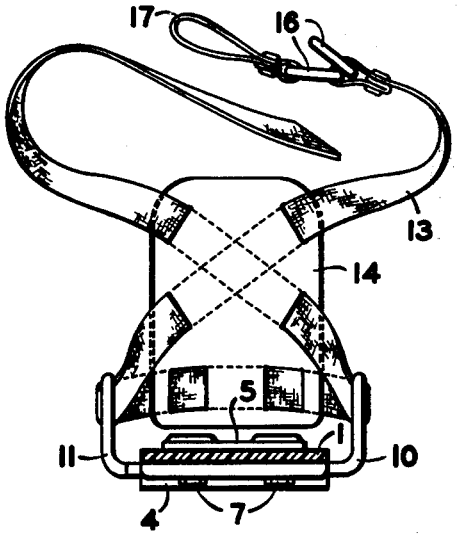
FIG. 4 is an elevation view of the heel portion of the binding viewed from the sectional plane taken along line 4—4 of FIG. 1 with the heel strap and heel pad attached.
Figure 5:
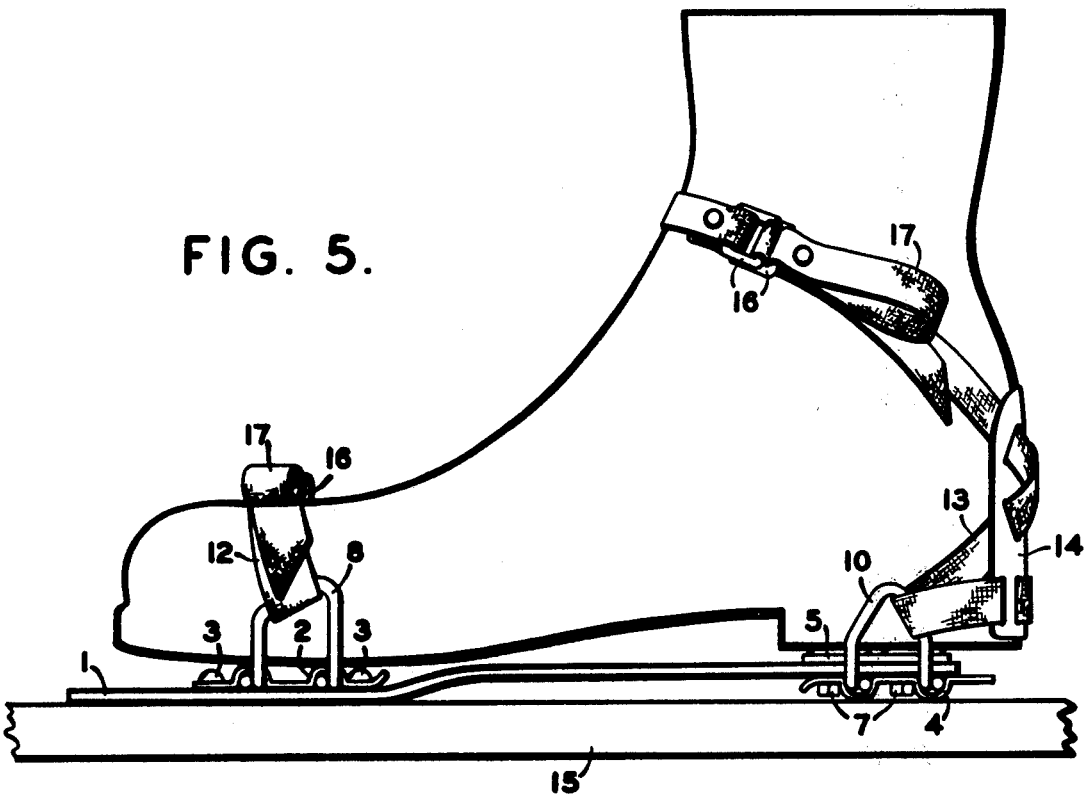
FIG. 5 is a side elevation view of the binding with a boot, shown in outline, held in the binding.
Figure 6:
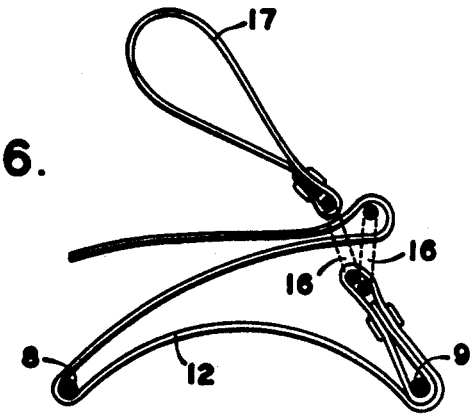
FIG. 6 is a sectional view of an alternate toe strap arrangement.

A toe strap 12 is attached to the toe brackets 8 and 9, as shown in FIG. 3. FIG. 6 shows an alternate method of attaching the toe strap 12. A heel strap 13 is attached to the heel brackets 10 and 11, and held in position by the slotted heel pad 14, as shown in FIG. 4. FIG. 5 shows both the toe strap 12 and heel strap 13 in a side elevation view.

The uni-flexible sole plate 1 may be of sheet plastic or any other material that will flex easily about an axis lying in the plane of the sheet surface, but which resists flexure about an axis perpendicular to the sheet surface. Other desirable properties include resistance to cracking and breakage when flexed continually at low winter temperatures, and a resistance to physical deterioration when exposed to sunlight, water, and other environmental factors present during winter skiing. The uni-flexible sole plate 1 may also consist of a combination of parts that together form a hinge, or series of connected hinge joints mechanically providing the required uni-directional flexure, thus allowing the heel to lift, but preventing lateral heel movement.

The toe brackets 8 and 9, and the heel brackets 10 and 11 provide raised portions at each side of the toe and heel to restrain the toe and heel, preventing lateral movement of the foot. The toe and heel brackets are illustrated in the drawings as formed from wire. Formed wire brackets require the use of a toe clamp plate 2 to secure the wire toe brackets to the toe portion of the sole plate 1, and a heel clamp plate 4 and heel top plate 5 to secure the wire heel brackets to the heel portion of the sole plate 1. Alternately, the toe brackets 8 and 9 and heel brackets 10 and 11 could be stamped from sheet metal or moulded from plastic or other materials, in which case the toe clamp plate 2, and heel clamp plate 4 would not be required because sheet metal or plastic toe and heel brackets can be provided with the necessary holes for direct attachment to the sole plate.

However, formed wire toe and heel brackets represent the preferred embodiment because they provide smoothly rounded strap attachment points, they allow a wide adjustment range and easy assembly, and they are generally cheaper to manufacture than stamped or moulded parts.

Figure 2:
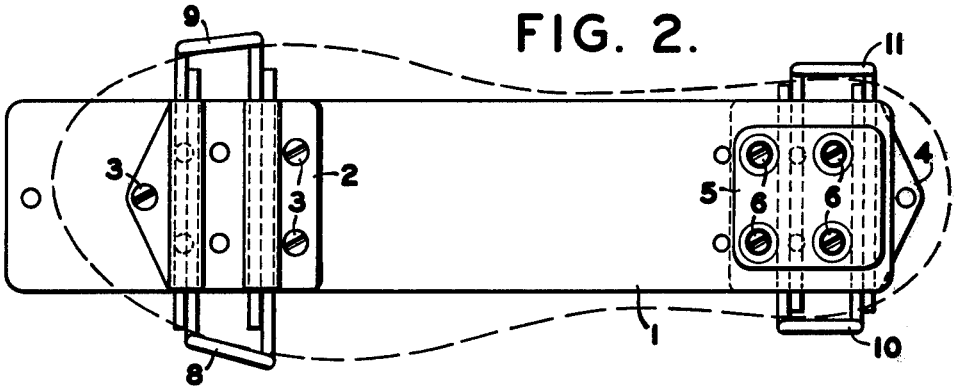
FIG. 2 is a top elevation view of the binding with the toe and heel straps removed, dotted lines indicate hidden parts, and the dashed line indicates the outline of a boot held in the binding.

The raised portions of the toe brackets 8 and 9 extend upward on each side of the toe, generally perpendicular to the plane of the sole plate 1, and adjacent to the sides of the boot. The upward extending portions of the toe brackets are formed at an angle converging toward a point forward of the toe, matching the usual shape of the toe portion of a boot, as shown in FIG. 2. The forwardly converging raised toe bracket portions prevent the boot from sliding forward in the binding, and prevent lateral movement of the toe. The raised portions of the heel brackets 10 and 11 extend upward on each side of the heel and prevent lateral movement of the heel.

A toe strap 12 passes through the toe brackets 8 and 9, and the ends are fastened together on top of the toe as shown in FIG. 3. A cross section of a similar toe strap arrangement is shown in FIG. 6. The toe strap in FIG. 6 is attached to one of the toe brackets by means of a short loop of strap.

Other strap configurations may also be used, such as separate toe strap sections attached to each toe bracket and openably fastened together over the toe.

In the preferred embodiment, shown clearly in FIGS. 3 and 6, the toe strap is fastened together with square rings 16, and a release loop 17, provided for easy opening, is attached to the lower ring. Alternate toe strap fastening means such as round rings and rings of other shapes, tabler buckles, tongue buckles, and web strap buckles may also be used.

The heel strap 13 prevents the foot from sliding backward, keeping the toe firmly locked under the toe strap, and the heel portion of the sole plate 1 up against the heel. When the sole plate 1 is held firmly up against the heel by the heel strap 13, the heel brackets 10 and 11 prevent lateral movement of the heel relative to the ski or other equipment.

In the preferred embodiment a single strap is passed around the right side of the ankle, behind the heel, through the raised portion of the left heel bracket, back around the heel, through the raised portion of the right heel bracket, back behind the heel, and up around the left side of the ankle where it is fastened to the other end of the heel strap. The three portions of the strap passing behind the heel are threaded through a heel pad 14 in the area of strap intersection, thus holding the heel strap in position and providing a cushion where the heel strap passes behind the heel of the boot. FIGS. 4 and 5 clearly show the preferred arrangement of the heel strap 13, and the heel pad 14.

Other heel strap configurations, such as separate heel strap sections attached to each heel bracket, crossing behind the heel, passing around each side of the ankle, and openably fastened together may also be used without departing materially from the heel strap configuration illustrated in the figures.

In the preferred embodiment the heel strap is openably fastened together with square rings 16, and a release loop 17, provided for easy opening, is attached to the lower ring in the same manner as described and illustrated for the toe strap. Alternate heel strap fastening means such as round rings and rings of other shapes, tabler buckles, tongue buckles, and web strap buckles may also be used.

The binding of the present invention may be easily adjusted to fit boots over a wide range of sizes and shapes. Loosening the mounting screws 3 that pass through the toe clamp plate 2 allows the toe brackets 8 and 9 to be adjusted to any desired spacing normally required. Two or more sets of mounting holes in the toe portion of the sole plate 1 allow two or more major length adjustments. Loosening the heel plate screws 6 allows the heel brackets to be adjusted to any desired spacing normally required. Two or more sets of heel plate holes in the heel portion of the sole plate 1 plus the option of turning the entire assembly of heel clamp plate 4, and heel top plate 5 around 180° allows four or more minor length adjustments. The heel strap 13 provides a final exact length adjustment when it is pulled snug and fastened.

I have illustrated the present invention as a ski binding because this represents a particularly prominent use of the invention. However, this invention may be used for any application where there is a need to attach a persons foot to an object in such manner as to allow the heel to freely raise, and where there is a requirement to restrain lateral movement of the foot relative to the attached equipment.

Furthermore, the heel strap arrangement in combination with any conventional means of restraining movement of the toe, such as a toe strap located ahead of the widest part of the foot or other material bracketing or enveloping the toe, thus restraining forward, upward, and lateral movement of the toe, and with a flexible, non-elastic connecting means provided beneath the foot to act as a sole plate connecting the heel strap to the toe restraining means, may be used for any application where lateral restraint is not as critical as is required for skiing. A snowshoe binding is a good example of such an application of the present invention requiring less lateral restraint.

The foregoing disclosure has described and illustrated the preferred embodiment of the present invention. A few alternate configurations have also been described briefly and other changes and modifications will be apparent to those skilled in the art. It is intended that this invention include all such changes and modifications falling within the scope of the appended claims.

I claim:

1. A binding comprised of a uni-flexible sole plate extending the length of the wearer's foot, said sole plate firmly attached with screws or other fasteners to a ski or other equipment at the forward end of the sole plate, toe brackets, one on each side of the foot at the toe, each toe bracket formed from a single piece of substantially smooth wire, each said wire toe bracket formed with a portion beneath the toe at the forward end of said sole plate, and a raised portion extending up alongside the toe, each said raised portion providing a straight portion of wire around which is looped a strap closure equipped toe strap that passes over the top of the toe and connects the toe bracket raised portions on opposite sides of the toe, said straight portion of wire inclined downward from rear to front alongside the toe at an angle matching the lay of said looped toe strap, and said raised straight portions on opposite sides of the toe forwardly converging, said wire toe bracket portion beneath the toe comprising the two end portions of said single piece of substantially smooth wire, said two wire end portions spaced apart and parallel to each other, and extending transverse to the length of said sole plate beneath the toe, each said wire end portion clamped, together with a corresponding wire end portion from the wire toe bracket on the opposite side of the toe, between said sole plate and a channel in a toe clamp plate, said toe clamp plate channels, two in number, dimensioned to hold two wire end portions from opposite toe brackets against said sole plate, parallel, overlapping, and adjacent to each other, each said toe clamp plate channel shaped to exert a frictional clamping force along a single line of contact on each toe bracket wire end portion, said line of contact positioned along the length of each side of said channel at a depth into the channel slightly greater than half the toe bracket wire diameter, said clamping force between sole plate and toe clamp plate upon said toe brackets generated by screws or other tightenable fasteners, said wire toe brackets laterally adjustable by means of loosening said screws or other tightenable fasteners, heel brackets, one on each side of the foot at the heel, each heel bracket formed from a single piece of substantially smooth wire, each said wire heel bracket formed with a portion beneath the heel at the rear end of said sole plate, and a raised portion extending up alongside the heel, said wire heel bracket raised portion providing a section of wire around which is fastened one end of a strap closure equipped heel strap, the free end of said heel strap passing up behind the heel, over the top of the foot, and down around behind the heel to a point of fastening around a section of wire on the heel bracket raised portion of the opposite wire heel bracket, said wire heel bracket portion beneath the heel comprising the two end portions of said single piece of substantially smooth wire, said two wire end portions spaced apart and parallel to each other, and extending transverse to the length of said sole plate beneath the heel, each said wire end portion clamped, together with a corresponding wire end portion from the wire heel bracket on the opposite side of the heel, between said sole plate and a channel in a heel clamp plate, said heel clamp plate channels, two in number, dimensioned to hold two wire end portions from opposite heel brackets against said sole plate, parallel, overlapping, and adjacent to each other, each said heel clamp plate channel shaped to exert a frictional clamping force along a single line of contact on each heel bracket wire end portion, said line of contact positioned along the length of each side of said channel at a depth into the channel slightly greater than half the heel bracket wire diameter, said clamping force between sole plate and heel clamp plate upon said heel brackets generated by bolts or other tightenable fasteners connecting said sole plate to said heel clamp plate, said wire heel brackets laterally adjustable by means of loosening said bolts or other tightenable fasteners.

2. A binding as defined in claim 1 wherein said strap closure equipped toe strap comprises a single length of strap with strap closure elements affixed to the two opposite strap ends of said single toe strap, said toe strap passing to and through one wire toe bracket raised portion, over the top of the toe, and to and through the opposite wire toe bracket raised portion, said opposite strap ends brought together over the top of the toe and openably fastened together by means of said strap closure elements, and a loop of strap affixed to said toe strap near one end of said toe strap, said loop of strap fastened around the wire toe bracket raised portion adjacent to said end of said toe strap, said loop of strap fastened around said wire toe bracket raised portion between said wire toe bracket and said toe strap.

3. A binding as defined in claim 1 wherein said strap closure equipped heel strap comprises a single length of strap with strap closure elements affixed to the two opposite ends of said single heel strap, said heel strap threaded, from a point on top of the foot, down around the back of the foot, through two close fitting slots in a heel pad, on around the heel to and through the wire heel bracket raised portion on one side of the heel, back behind the heel through two close fitting slots in said heel pad, on around the heel to and through the heel bracket raised portion on the opposite side of the heel, back up behind the heel through two close fitting slots in said heel pad, and on around to the top of the foot at which point the opposite ends of said single heel strap are openably fastened together by means of said strap closure elements.

* * * * *